US005322183A

United States Patent [19]

Strachan

[11] Patent Number: 5,322,183

[45] Date of Patent: Jun. 21, 1994

[54] PAINT RECEPTACLE

[76] Inventor: David G. Strachan, 20 Albert St., Markham, Ontario, Canada, K3P 2T5

[21] Appl. No.: 24,323

[22] Filed: Mar. 1, 1993

Related U.S. Application Data

[63] Continuation of Ser. No. 740,059, Aug. 5, 1991, abandoned.

[51] Int. Cl.[5] ..... B65D 25/00

[52] U.S. Cl. ..... 220/697; 220/698; 220/700; 220/701; 220/735; 220/736; 220/636

[58] Field of Search ..... 220/697, 736, 735, 698, 220/700, 701, 702, 635, 636

[56] References Cited

U.S. PATENT DOCUMENTS

| | | | |
|---|---|---|---|
| 2,567,326 | 9/1951 | Entsminger | 220/696 |
| 2,748,977 | 6/1956 | Sarchet | 220/697 |
| 3,407,429 | 10/1968 | Di Nardo | 220/735 X |
| 5,007,553 | 4/1991 | Curtis | 220/697 |

FOREIGN PATENT DOCUMENTS

| | | | |
|---|---|---|---|
| 188682 | 4/1937 | Switzerland | 220/736 |
| 0930271 | 7/1963 | United Kingdom | 220/700 |

*Primary Examiner*—Allan N. Shoap
*Assistant Examiner*—Paul A. Schwarz
*Attorney, Agent, or Firm*—Eugene J. A. Gierczak

[57] ABSTRACT

A paint brush receptacle engageable with the peripheral edge of an open paint can comprising a bottom wall, front, back, and a pair of side walls upstanding from said bottom wall and terminating at an open end for receiving paint brushes therein; the bottom wall having an extension projecting exteriorly outwardly therefrom; a leg depending from said extension and spaced from said back wall for insertion into said paint can and releasably engageable with said peripheral edge of said open paint can; a scraper extending outwardly from said extension for scraping paint off said paint brush into said open paint can.

13 Claims, 8 Drawing Sheets

FIG. 1

FIG. 4

PAINT RECEPTACLE

This is a continuation of application Ser. No. 07/740,059, filed Aug. 5, 1991, now abandoned.

FIELD OF INVENTION

This invention relates to paint brush receptacles adapted to accommodate paint brushes and in particular relates to paint receptacles engageable with the peripheral inner edge of an open paint can.

BACKGROUND OF THE INVENTION

Persons who generally paint articles or buildings typically insert a paint brush into an open paint can and scrape excess paint therefrom against the inner peripheral edge of the open paint can. Such action usually results in spillage of paint into the rim channel of the paint can making it difficulty and messy to close.

Furthermore, it becomes difficult for a user of an open paint can to grasp the handle of an open paint can in one hand while holding a paint brush in either the same or other hand while climbing a ladder.

Various devices have heretofore been devised in order to minimize the spillage of paint onto the rim channel of a paint can as well as the transporting a paint brush.

For example, U.S. Pat. No. 3,688,943 relates to a plastic ring provided at its outer edge with a flange or other clamping mechanism to fit over and to attach securely to the circular rim of an open paint can and includes a container which is secured to the plastic rim by means of a hooking mechanism.

Moreover, U.S. Pat. No. 4,094,431 illustrates an assembly comprising a paint tray with a paint brush attachment for simultaneously accommodating both a paint roller and a paint brush.

Yet another arrangement is shown in U.S. Pat. No. 4,867,322 which relates to a tool holder which holds tools within a container such as a 5 gallon bucket.

Yet another arrangement is shown in U.S. Pat. No. 3,581,904 which relates to a paint sieve having a top opening to receive a brush and adapted for variable height attachment inside a paint bucket so that the sieve can be raised or lowered in the bucket to remain partially emersed in the paint during painting.

Finally, U.S. Pat. No. 4,765,472 illustrates a bucket attachment tool holder for mounting on a conventional bucket having a loop handle.

These and other prior art devices present relatively complicated structure having limited utility.

It is an object of this invention to provide an improved paint brush receptacle which is easy to use and construct.

The broadest aspect of this invention relates to a paint brush receptacle adapted to engage the peripheral edge of an open paint can comprising: a bottom wall presenting upstanding wall formations terminating at an open end for receiving paint brushes therein; one of said wall formations having a concave surface so as to conform to and contact the side of said paint can, said one of said wall formations having an extension projecting outwardly away from said concave surface and terminating along a convex edge; a leg having a convex surface depending from said convex edge of said extension and spaced generally equally from said one of said wall formations for insertion into said open paint can and releasably engageable with said peripheral edge of said open paint can and for insertion of a thumb between said depending leg and said back wall to stabilize the receptacle when said receptacle is separated from said paint can; and scraper extending outwardly from said convex edge of said extension and beyond said extension for scraping paint off said paint brush into said open paint can; a peripheral edge projecting downwardly from said bottom wall in the region remote from said extension.

It is another aspect of this invention to provide a paint brush receptacle engageable with an open paint can having a cylindrically shaped exterior surface and a round peripheral inner edge, a round peripheral outer edge and a rim channel, said receptacle comprising: a bottom wall; a back wall, a front wall and a pair of side walls vertically upstanding from said bottom wall and terminating at an open end for receiving paint brushes therein; wherein said back wall is concave so as to conform to and contact said exterior surface of said paint can; an extension projecting horizontally outwardly from said back wall and terminating along a convex edge; a leg depending vertically downwardly from said convex edge of said extension, spaced from said back wall, said leg having a convex surface generally spaced equally from said back wall for insertion into said open paint can and releasably engageable with a portion of said peripheral inner edge of said open paint can and for the insertion of a thumb between said depending leg and said back wall to stabilize the receptacle when said receptacle is separated from said paint can; a scraper edge extending angularly upwardly from said convex edge of said extension and extending outwardly beyond said extension and said leg for scraping paint off said paint brush into said paint can; said extension overlaying a portion of said rim channel so as to present a barrier against paint dripping onto said rim channel; and a peripheral edge projecting vertically downwardly from said bottom wall in the region remote from said extension.

These and other objects and features shall now be described in relation to the following drawings.

DESCRIPTION OF INVENTION

Like parts have been given like numbers throughout the Figures.

Figure 1:
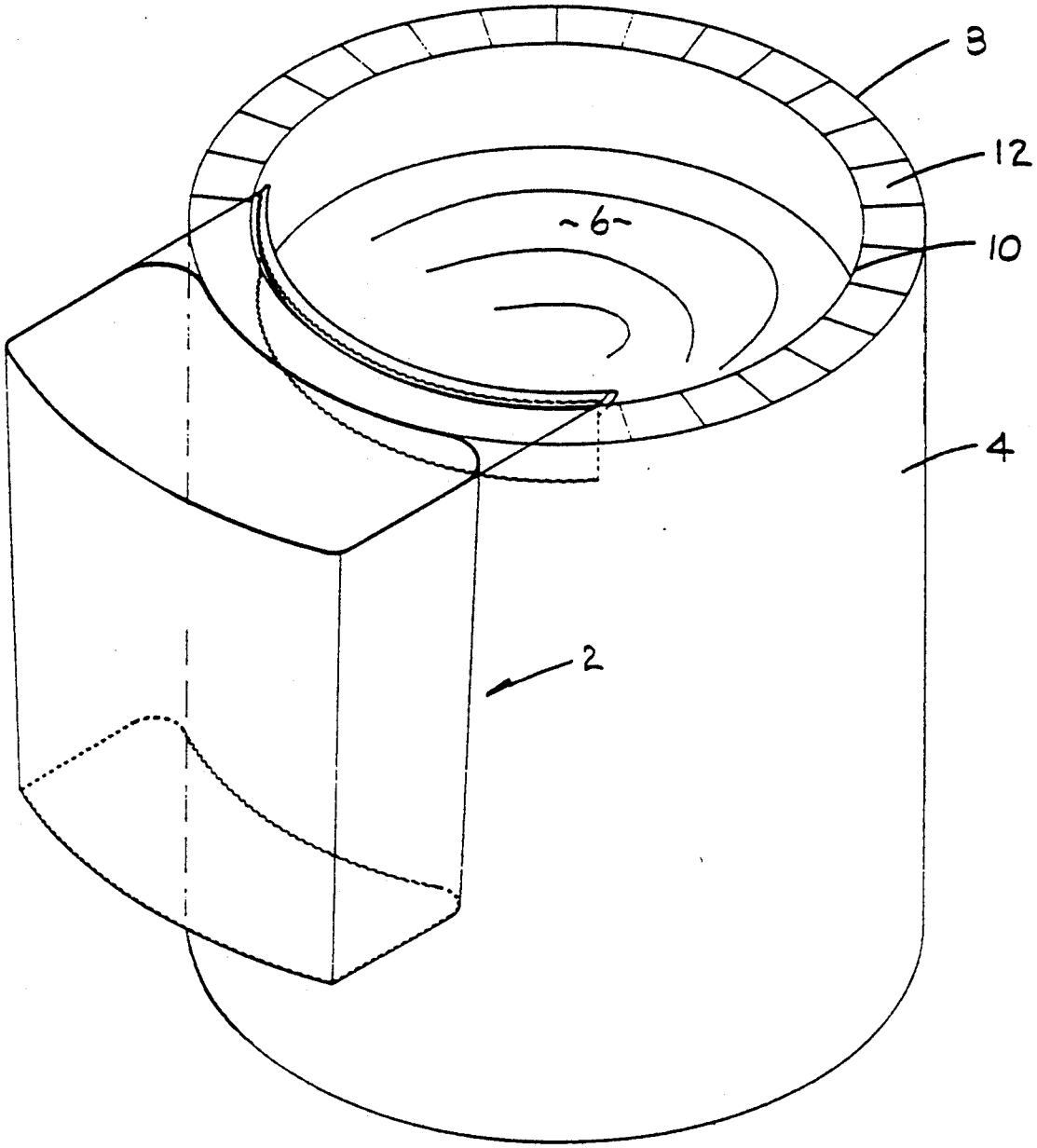
FIG. 1 is a perspective view of the paint brush receptacle which is releasably securable to an open paint can.
Figure 2:
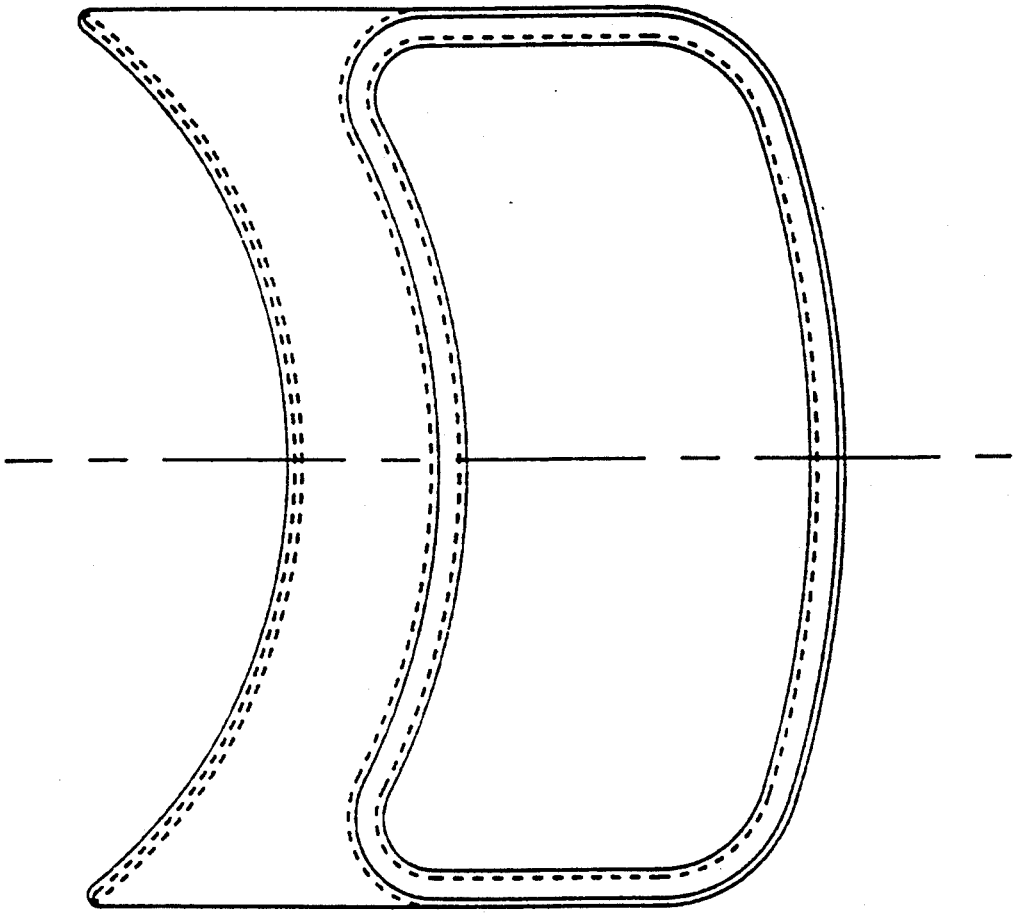
FIG. 2 is a bottom plan view of the paint brush receptacle.

FIG. 1 illustrates the paint brush receptacle 2 releasably secured to open paint can 4.

The open paint can contains paint 6 and has an outer peripheral edge 8, an inner peripheral edge 10, and a rim channel 12 for reception of a cover (not shown).

The paint brush receptacle 2 may be comprised of a variety of materials including plastic polypropylene and the like.

The paint brush receptacle 2 includes a bottom wall 14 having a pair of spaced apart side walls 16 and a front wall 18 and back wall 20.

The back, front, and side walls 20, 18 and 16 respectively extend vertically upwardly from the bottom wall 14 and terminate at an open end 22 for insertion of paint brushes or the like within the confines of the receptacle 2.

One of said upstanding walls and in particular the back wall 20 presents a horizontally extending extension or angular ring portion 24 which projects exteriorally outwardly from the back wall 20. The extension 24 is connected to the back wall 20 in the vicinity of the open end 22 and terminates at the other end thereof so as to present a depending leg 26 which is adapted to be inserted into the interior of the open paint can 4.

The depending leg 26 depends vertically downwardly from the extension 24. Furthermore, a scraper edge or lip 28 projects vertically upwardly from the extension 24 so as to present a scraper edge adapted to scrape excess paint from a paint brush into the open paint can.

The paint brush receptacle 2 presents a vertical upstanding back wall 20 which has a curved surface 30 adapted to conform to and contact the outer surface of paint can 4. In particular, the back wall 20 has a concave surface designed to contact and conform the outer surface of the paint can 4.

Figure 3:
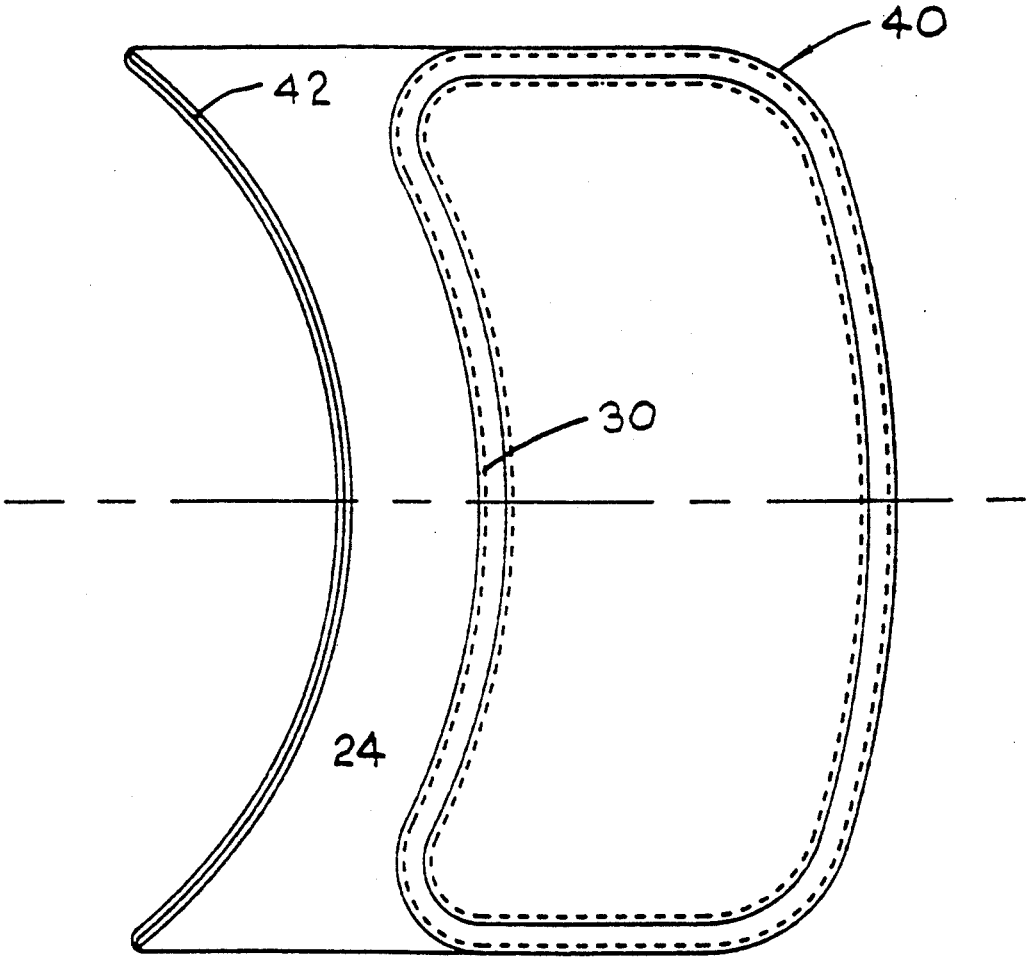
FIG. 3 is a top plan view of the paint brush receptacle releasably engageable with the peripheral edge of the paint brush receptacle.
Figure 4:
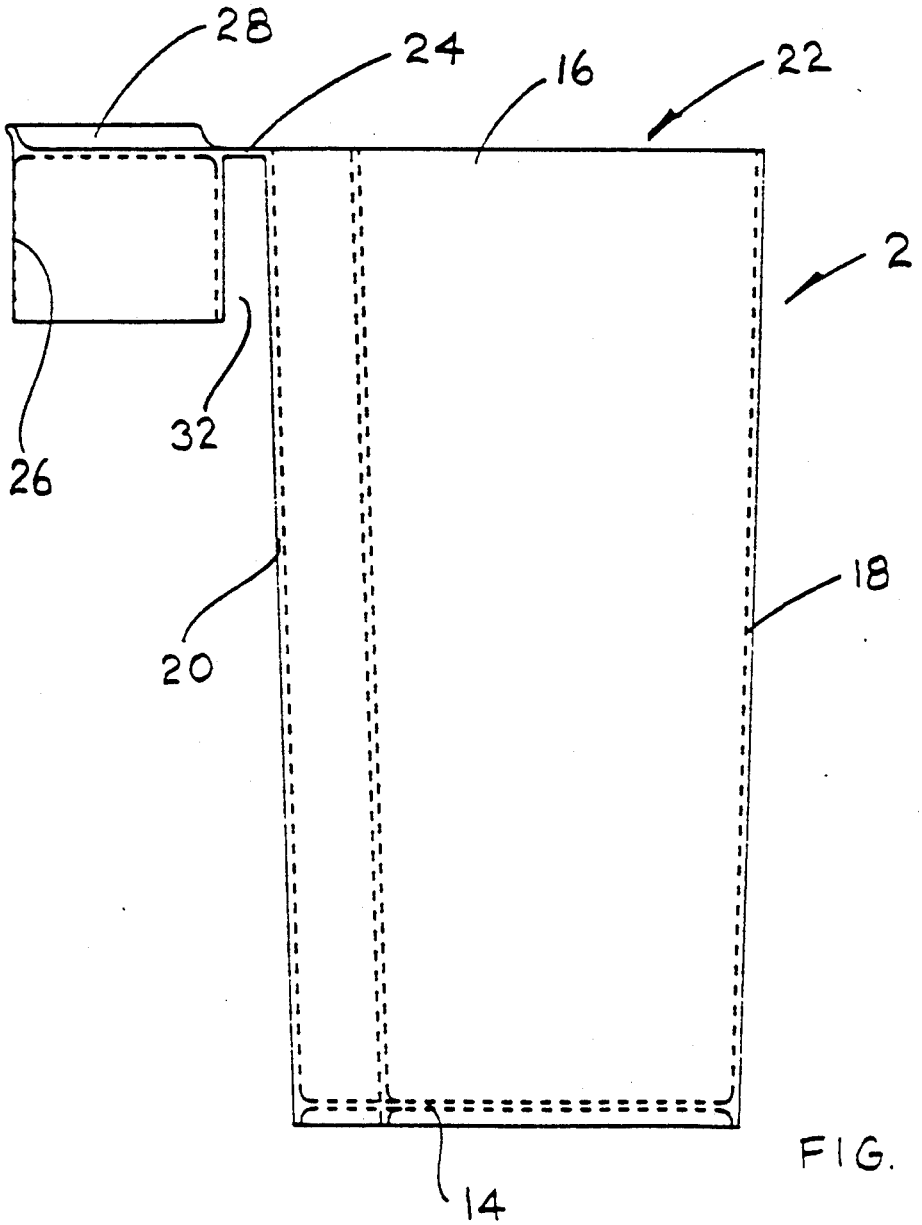
FIG. 4 is a side elevational view of the paint can.
Figure 5:
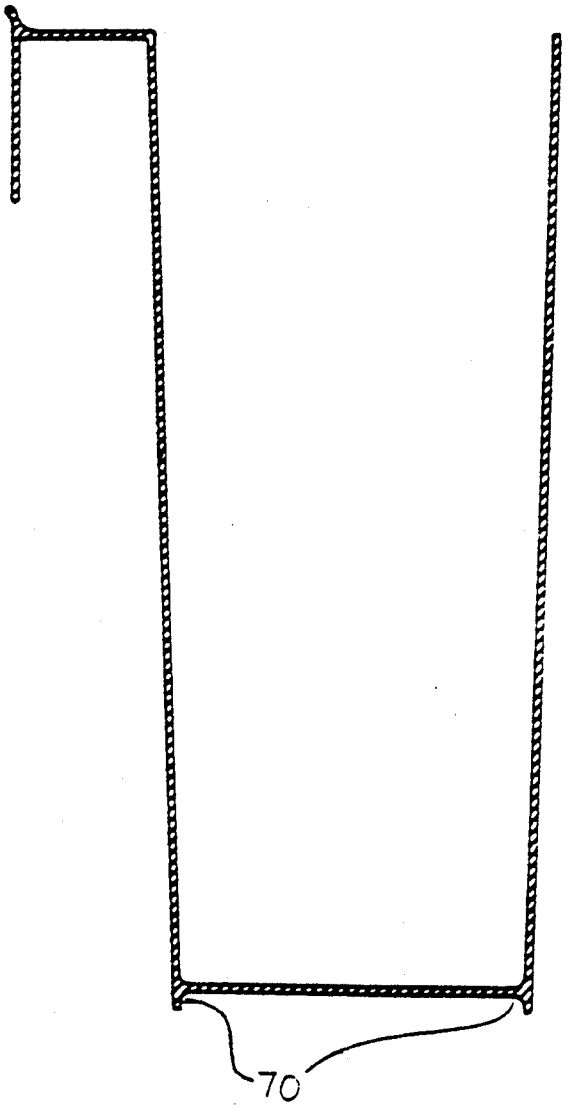
FIG. 5 is a cross-sectional view of the paint brush receptacle taken along the lines 5—5 of FIG. 2.
Figure 6:
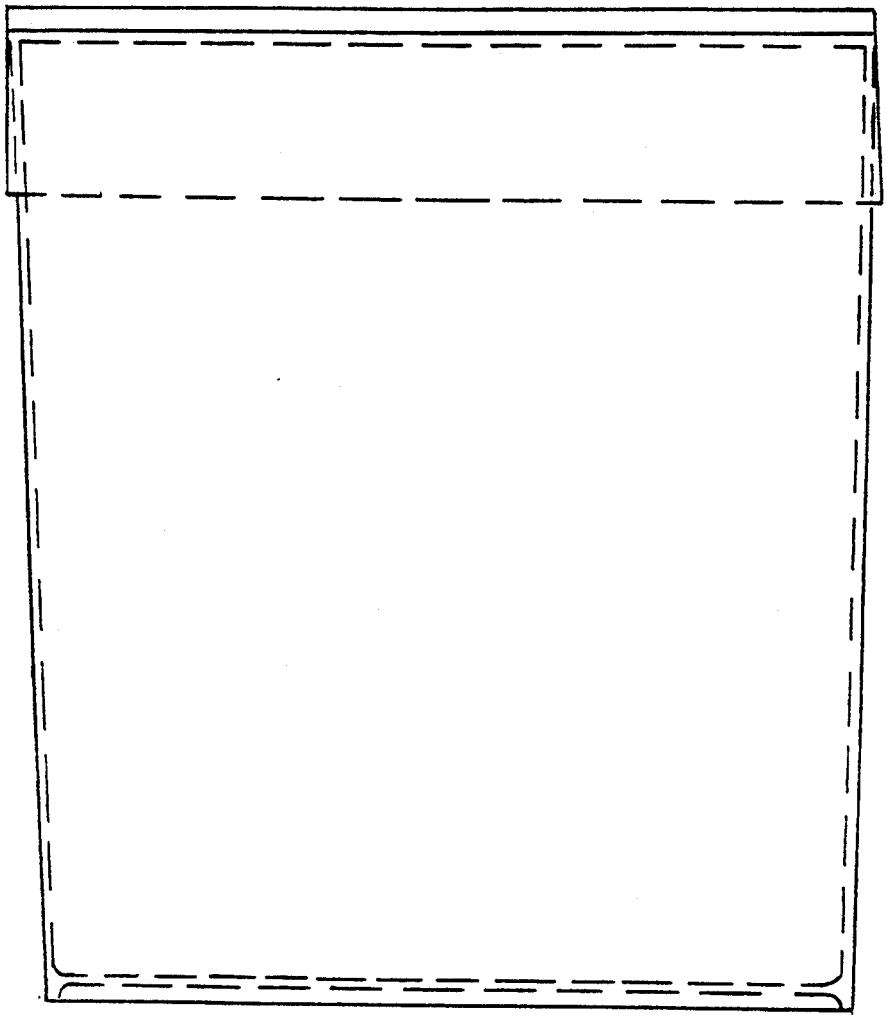
FIG. 6 is a front elevational view of the paint brush receptacle.
Figure 7:
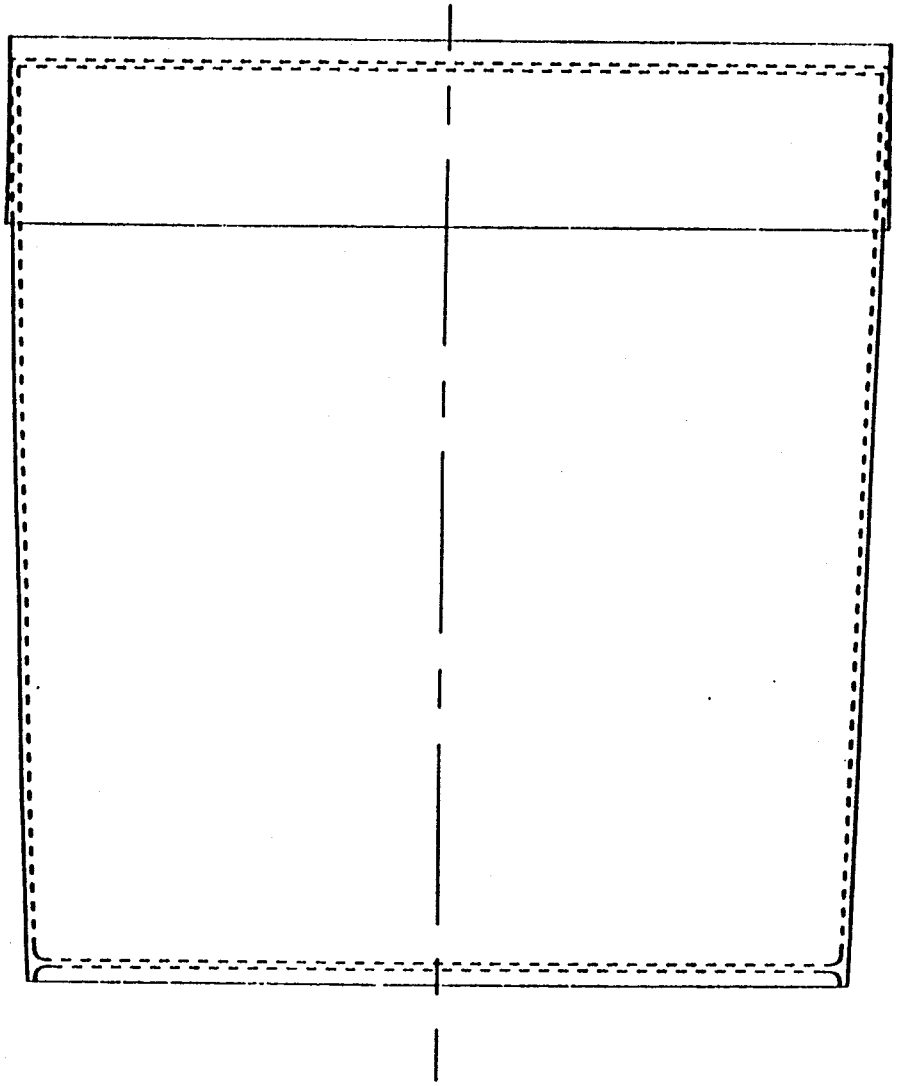
FIG. 7 is a back elevational view of the paint brush receptacle.

The extension 24 has an annular horizontal shape which is adapted to overly a portion of the rim 12 as best illustrated in FIG. 3. In particular, the extension 24 presents a barrier to the dripping of paint 6 into the rim channel 12.

The depending leg 26 presents a space 32 within the confines of the back wall 20, extension 24 and leg 26 for accommodating the thumb of a user. In particular, the receptacle 20 may be removed from the paint can 4 and a brush (not shown) may be inserted within the receptacle 2 for painting of an article or wall or the like whereby the user would grasp the receptacle 2 in a fashion so as to insert the thumb within the space 32 and the fingers would grasp the front wall 18. Such use would stabilize the receptacle 2 during use thereof when separated from the paint can 4.

The front wall 18 also includes a convex surface and the corners 40 of the receptacle are rounded so as to facilitate a production thereof. The depending leg presents a convex surface 42 as best illustrated in FIG. 3 which is adapted to contact the inner peripheral edge 10 of the open paint can 4 so as to releasably secured or hang the receptacle 2 from the paint can 4.

The leg 26 depends vertically downwardly from the underside of the extension 24 and presents a convex surface which contacts the inner peripheral edge 10.

The scraper 28 projects outwardly from the upper surface of extension 24 and is also convex shaped and adapted to scrape excess paint from a paint brush (not shown) back into the open paint can 4. More particularly, the lip 28 extends outwardly from the extension or angular portion 24 so that the excess paint scraped against lip 28 drips back into the paint can rather than extension 24.

The upstanding front, back, and side walls 18, 20 and 16 respectively are tapered so as to assist in the stacking thereof.

The paint brush receptacle 2 as described herein provides a place to carry or store the paint brush (not shown) while transporting the open pail of paint 4. Moreover, the paint brush receptacle 2 provides the user with a place to wipe excess paint while painting, as the unwanted or excess paint returns to the original source for further use.

Moreover, the paint 6 no longer collects in the rim 12 of the paint can 4 thus avoiding spillage when the lid (not shown) is put back onto the paint can 4.

Furthermore, the paint brush receptacle 2 provides a location to store a brush (not shown) if painting is interrupted and the user plans to continue painting in a reasonable amount of time. Moreover, the paint brush receptacle 2 provides the user with an area to put the brush into while the user is climbing a ladder or scaffold so that the user will be able to manipulate one hand to firmly grasp the rungs of the ladder or scaffold.

The paint brush receptacle 2 can also be used to store a small amount of paint as a painting source for doing touch up work as the concave shape as described above lends itself to securely grasp the receptacle 2 by inserting the thumb into space 32. Moreover, the thumb of the user into the space 32 can be equally used by right or left handed persons.

The paint brush receptacle 2 can also be used to house a cleaning solvent to completely clean and soak a brush once painting is completed or one can store a brush (once cleaned) therein.

Furthermore, the dimensioning of the paint brush receptacle 2 facilities the ability to use 2 receptacles at one time on a paint can 4.

Finally, the paint brush receptacle can be used to store additional brushes as different brushes need to be used and can also be used to store water for latex painting so that the brush is already soaking while another brush is being used.

Figure 8:
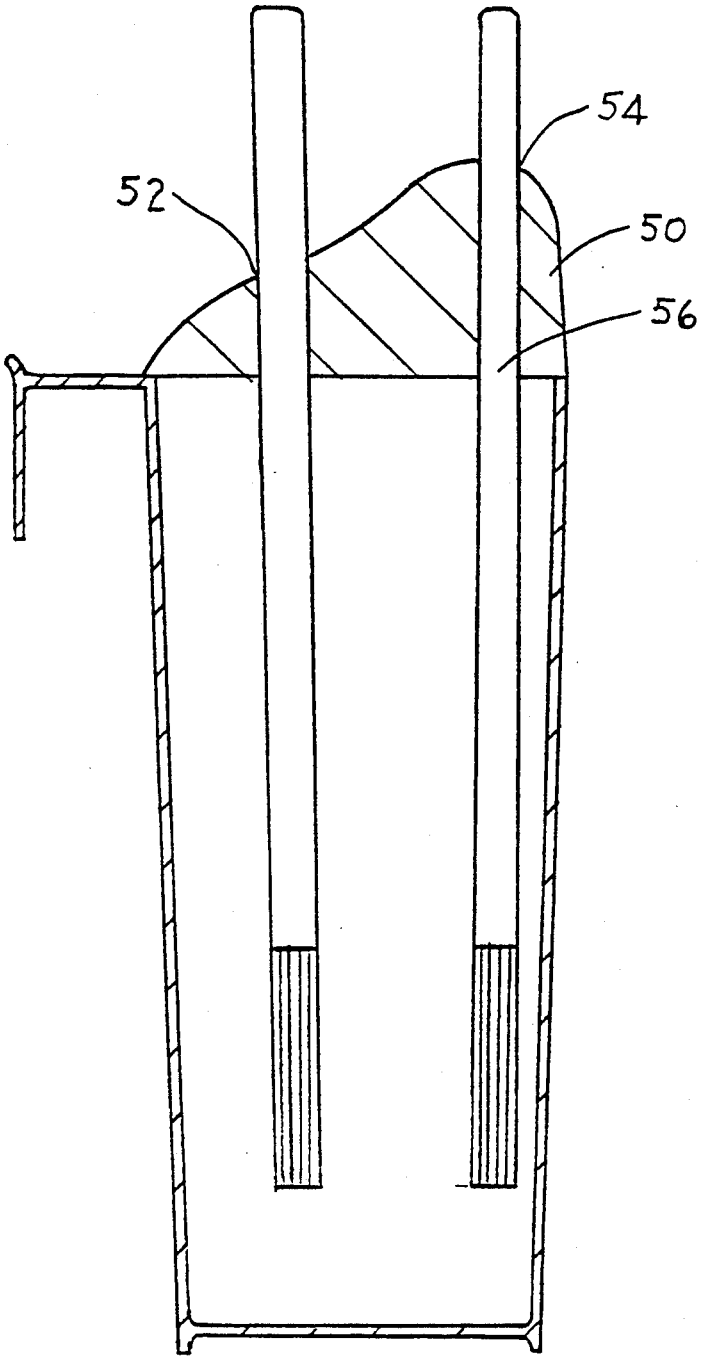
FIG. 8 is a cross-sectional view of the paint brush receptacle with a cover.

FIG. 8 illustrates a cover 50 which may be used in connection with the paint brush receptacle. The cover 50 is made of polypropylene and is dimensioned so as to frictionally engage an upstanding wall formation and includes two receiving slots 52 and 54 which are dimensioned so as to frictionally engage and secure brush handles 56. The cover can be used in cases where it is desired to retain a brush in receptacle 2 with cleaning solvent or the like.

The bottom wall 14 presents a peripheral edge 70 projecting outwardly or downwardly from the bottom wall 14 in the region remote from the extension.

Although the preferred embodiment of the invention has been described herein, it would be apparent to one skilled in the art the variations may be made thereto without departing from the spirit of the invention or the scope of the appended claims.

The embodiments of the invention in which an exclusive property or privilege is claimed are defined as follows:

1. In a paint brush receptacle adapted to engage the peripheral edge of an open paint can comprising:

(a) a bottom wall presenting upstanding wall formations terminating at an open end for receiving paint brushes therein;

(b) one of said wall formations having a concave surface so as to conform to and contact the side of said paint can, said one of said wall formations having an extension projecting outwardly away from said concave surface and terminating along a convex edge;

(c) a leg having a convex surface depending from said convex edge of said extension and spaced generally equally from said one of said wall formations for insertion into said open paint can and releasably engageable with said peripheral edge of said open paint can and for insertion of a thumb between said depending leg and said one of said wall formations to stabilize the receptacle when said receptacle is separated from said paint can; and (d) scraper means extending outwardly from said convex edge of said extension and beyond said extension for scraping paint off said paint brush into said open paint can.

(e) a peripheral edge projecting downwardly from said bottom wall in the region remote from said extension.

2. In a paint brush receptacle as claimed in claim 1 wherein said paint can presents a circular peripheral edge and said extension is adapted to overlie a portion of said circular peripheral edge of said open paint can to present a barrier against paint dripping onto said circular peripheral edge of said open paint can.

3. In a paint brush receptacle as claimed in claim 2 wherein said wall formations are tapered from said open end to said bottom wall for facilitating stacking of said receptacle.

4. In a paint brush receptacle as claimed in claim 3 wherein said upstanding wall formations define a back wall, front wall and a pair of spaced side walls.

5. In a paint brush receptacle as claimed in claim 4 wherein said back wall defines said concave surface.

6. In a paint brush receptacle as claimed in claim 5 wherein said scraper means defines a curved scraper edge.

7. In a paint brush receptacle engageable with an open paint can having a cylindrically shaped exterior surface and a round peripheral inner edge a round peripheral outer edge and a rim channel, said receptacle comprising:

(a) a bottom wall;

(b) a back wall, a front wall and a pair of side walls vertically upstanding from said bottom wall and terminating at an open end for receiving paint brushes therein;

(c) wherein said back wall is concave so as to conform to and contact said exterior surface of said paint can;

(d) an extension projecting horizontally outwardly from said back wall and terminating along a convex edge;

(e) a leg depending vertically downwardly from said convex edge of said extension, spaced from said back wall, said leg having a convex surface generally spaced equally from said back wall for insertion into said open paint can and releasably engageable with a portion of said peripheral inner edge of said open paint can and for the insertion of a thumb between said depending leg and said back wall to stabilize the receptacle when said receptacle is separated from said paint can;

(f) a scraper edge extending angularly upwardly from said convex edge of said extension and extending outwardly beyond said extension and said leg for scraping paint off said paint brush into said paint can;

(g) said extension being adapted to overlie a portion of said rim channel so as to present a barrier against paint dripping onto said rim channel; and (h) a peripheral edge projecting vertically downwardly from said bottom wall in the region remote from said extension.

8. In a paint can receptacle as claimed in claim 7 wherein said scraper edge defines a concave scraper edge.

9. In a paint brush receptacle as claimed in claim 8 wherein said walls, exterior, leg, and scraper edge are integral with each other.

10. In a paint brush receptacle as claimed in claim 9 wherein said receptacle is comprised of plastic.

11. In a paint brush receptacle as claimed in claim 10 further including a cover engageable with said receptacle, said cover including receiving slot means for receiving said brushes therein.

12. In paint brush receptacle as claimed in claim 11 wherein said back wall, front wall and pair of side walls are tapered from said open end to said bottom wall to accommodate stacking of receptacles.

13. In a paint brush receptacle as claimed in claim 12 wherein said horizontal extension is disposed at an angle greater than 90° relative said back wall.

* * * * *